US005846066A

United States Patent [19]

Troup

[11] Patent Number: 5,846,066

[45] Date of Patent: Dec. 8, 1998

[54] VACUUM PUMPS WITH CLAW-TYPE ROTOR AND ROOTS-TYPE ROTOR NEAR THE OUTLET

[75] Inventor: Alan Paul Troup, Horsham, England

[73] Assignee: The Boc Group plc, Windlesham, England

[21] Appl. No.: 807,513

[22] Filed: Feb. 27, 1997

[30] Foreign Application Priority Data

Mar. 1, 1996 [GB] United Kingdom ..... 9604486

[51] Int. Cl.[6] ..... F04C 18/18; F04C 25/02

[52] U.S. Cl. ..... 418/3; 418/9

[58] Field of Search ..... 417/205, 244; 418/3, 9

[56] References Cited

U.S. PATENT DOCUMENTS

| | | | |
|---|---|---|---|
| Re. 25,567 | 5/1964 | Lorenz | 230/139 |
| 4,934,908 | 6/1990 | Turrell et al. | 418/9 |
| 4,940,398 | 7/1990 | Berges et al. | 417/410 |
| 4,983,107 | 1/1991 | Steffens et al. | 418/9 |
| 4,995,796 | 2/1991 | Kambe et al. | 418/9 |

OTHER PUBLICATIONS

Wycliffe, H., "Mechanical high–vacuum pumps with an oil–free swept volume," J. Vac. Sci. Technol. A5(4), Jul./Aug. 1987, pp. 2608–2611.

*Primary Examiner*—Timothy Thorpe
*Assistant Examiner*—Ehud Gartenberg
*Attorney, Agent, or Firm*—David M. Rosenblum; Salvatore P. Pace

[57] ABSTRACT

A mechanical vacuum pump having mounted in each of at least three pumping chambers a pair of intermeshing rotors. A first rotor of each pair being mounted for rotation on a first shaft passing through the chambers and a second rotor of each pair being mounted for rotation on a second shaft passing through the chambers. The first and second shafts are driven in contra-rotating directions to effect a sequential pumping action by the pairs of rotors in each chamber in respect of gas being pumped between a pump inlet and a pump outlet. The pump possesses at least one chamber with claw-type profile rotors and one ore more chambers with roots-type profile rotors. The chamber nearest the pump outlet has a rotor with a roots-type profile.

4 Claims, 1 Drawing Sheet

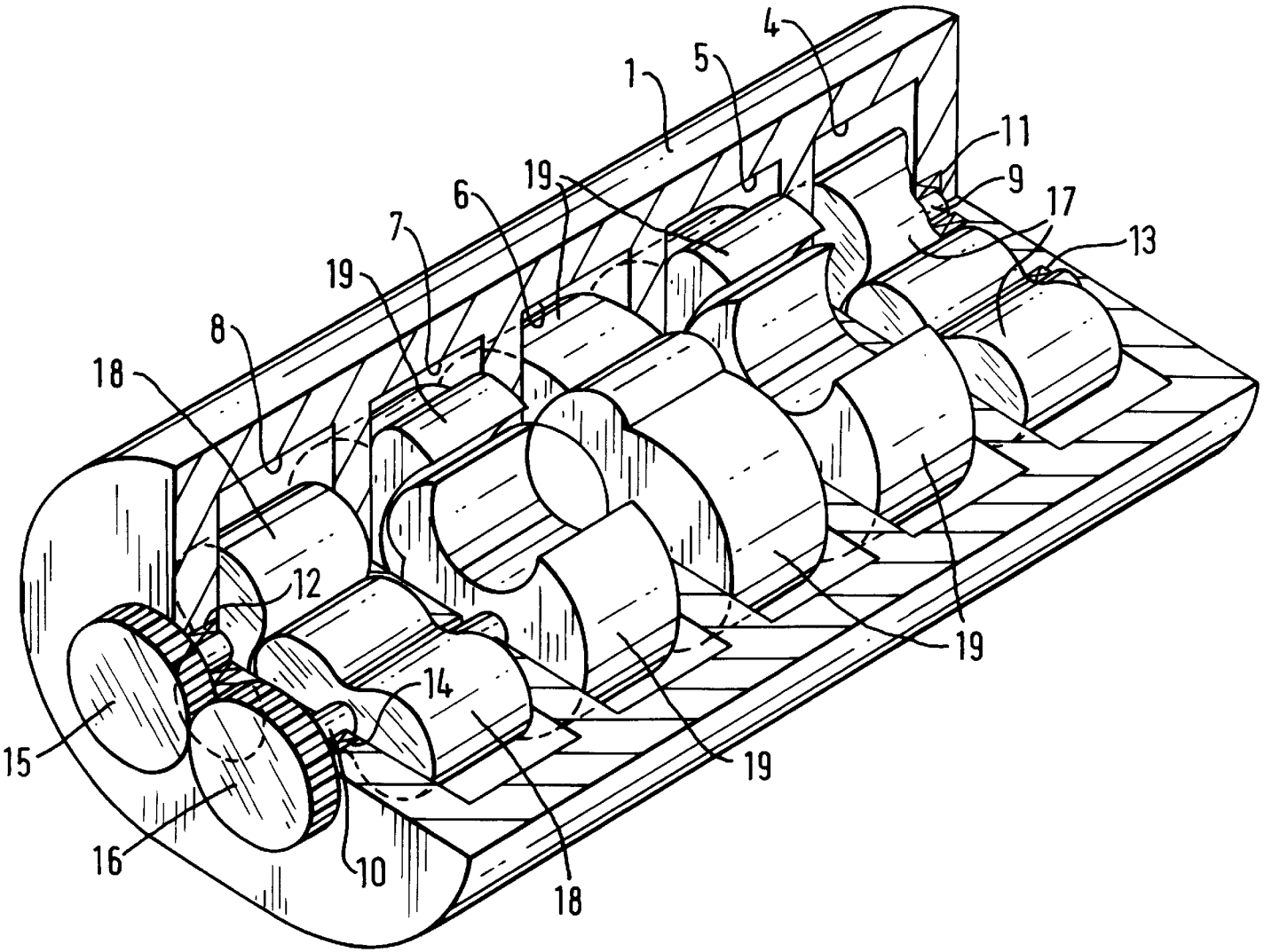
1
4
5
6
7
8
9
10
11
12
13
14
15
16
17
18
19

VACUUM PUMPS WITH CLAW-TYPE ROTOR AND ROOTS-TYPE ROTOR NEAR THE OUTLET

BACKGROUND OF THE INVENTION

This invention relates to improvements in vacuum pumps and, more particularly, to those in multi-stage, oil-free (dry) vacuum pumps.

Vacuum pumps are known which are oil-free in their vacuum chambers and which are therefore useful in clean environments such as those found in the semi-conductor industry in which any lubricants present in the vacuum chambers might cause contamination.

Such dry vacuum pumps are commonly multi-stage positive displacement pumps employing inter-meshing rotors in each vacuum chamber. The rotors may have the same type of profile in each chamber or the profile may change from chamber to chamber.

It is known in particular—see a paper by Wycliffe of our Edwards High Vacuum International Division in J. Vac Sci Technol. A5(4) July/August 1987 the contents of which are incorporated herein by reference—that a vacuum pump can advantageously have a first chamber adjacent the pump inlet containing a pair of "Roots"-type profile rotors (two, three or four lobe rotors could be used although only two-lobe are shown) with another chamber adjacent the pump outlet containing a pair of "Claw"-type rotors and with a further chamber intermediate these two chambers also containing a pair of "Claw"-type rotors.

Such an arrangement has been widely used in practice in that it exhibits a good combination of properties, namely an effective, high volumetric efficiency from the "Roots" profile chamber, especially in the pressure region of from 0.001 to 10 mbar when delivering at low pressure differentials coupled with an ability of the "Claw" profile chambers to deliver against high pressure differentials to atmosphere at the pump outlet.

There are, however, certain disadvantages to a vacuum pump containing such mixed rotor profiles. One of them is the fact that the pump suffers higher power consumption in a roughing mode at the start of an evacuation. Another is noise caused in particular by the Claw profile rotors in the chamber adjacent the pump outlet expelling discrete trapped volumes of evacuated gas to atmosphere from between the Claw rotors in a manner known per se in a pulsed manner.

It has now been found that such multi-stage, different profile pumps may be further improved by the selection of a specific new combination of profiles in the different pump chambers.

SUMMARY OF THE INVENTION

In accordance with the invention, there is provided a vacuum pump having mounted in each of at least three pumping chambers a pair of intermeshing rotors, a first rotor of each pair being mounted for rotation on a first shaft passing through the chambers and a second rotor of each pair being mounted for rotation on a second shaft passing through the chambers, and means to drive the shafts in contra-rotating directions to effect a sequential pumping action by the pairs of rotors in each chamber in respect of gas being pumped between a pump inlet and a pump outlet, wherein the pump possesses at least one chamber with "Claw" type profile rotors and at least one chamber with "Roots"-type profile rotors and wherein the chamber nearest the pump outlet has "Roots"-type profile rotors.

It has been found that the advantage of the "Roots" final stage pump of the invention is that the pulsation frequency is much higher than for a "Claw" stage. For example for a five lobe "Roots" profile, the pulsation frequency is ten times that of a "Claw" profile. This results in less energy per pulse and therefore a lower noise level. The higher frequency is also less able to excite vibrations in downstream pipework. This allows the pump to operate without the need for an external silencer.

A further advantage of the pump of the invention is that during roughing the roots stage can more efficiently allow the excess pressure generated by a previous "Claw" stage to be discharged. This will generally reduce the motor power required for roughing.

Preferably, the chamber nearest the pump inlet also has "Roots"-type profile rotors as this provides the general overall benefits of the pump referred to in the Wycliffe paper above but generally without the disadvantages referred to above. In such embodiments in a three stage pump, the chambers would therefore possess between the pump inlet and the pump outlet (1) a "Roots"-type rotor profile chamber, (2) a "Claw"-type rotor profile and (3) a "Roots"-type rotor profile chamber.

The pumps of the invention advantageously possess at least four stages, ideally with "Roots"-type profile rotors in the chambers adjacent both the pump inlet as well as the pump outlet and with "Claw"-type profile rotors in the intermediate chambers.

Pumps with more than four stages would also preferably possess "Roots"-type profile rotors in the chambers adjacent the pump inlet and pump outlet with all the intermediate chambers having "Claw"-type profile rotors.

BRIEF DESCRIPTION OF THE DRAWINGS

For a better understanding of the invention, reference will now be made, by way of exemplification only, to the accompanying drawing which shows a schematic representation of a cross section of a pump of the invention.

DETAILED DESCRIPTION

With reference to the drawing, there is shown a five stage vacuum pump comprising a pump body 1 having an inlet (not shown) and an outlet (not shown) formed therein.

Positioned between the inlet and the outlet are five pumping chambers 4,5,6,7,8. Two shafts 9,10 are mounted within the pump body 1 by means of bearings 11,12 and 13,14 respectively such that they pass through each of the pumping chambers 4,5,6,7.

The shafts 9,10 are adapted for rotation within the pump body about their longitudinal axes in contra-rotational direction by virtue of the shaft 9 being connected to a drive motor (not shown) and by virtue of the shaft 10 being coupled to the shaft 9 by means of timing gears 15,16 attached to the respective shafts.

Although lubrication is normally required in the gearbox containing the gears 13,14, this can be kept away from the pumping chambers 4,5,6,7 which are therefore kept dry and clean.

Five rotors are mounted on each shaft 9,10 positioned so that one from each shaft is located in each chamber 4,5,6,7,8. The rotors 17 in the chamber 4 nearest the pump inlet and the rotors 18 in the chamber 8 nearest the pump outlet are all of a "Roots"-type profile whereas the rotors 19 in the intermediate chambers 5,6 and 7 are all of a "Claw"-type profile.

The pairs of rotors in each chamber 4,5,6,7,8 are all positioned on their respective shafts and located within the chambers relative to the chamber walls such that they can act in an intermeshing manner in a manner known per se in respect of vacuum pumps in particular.

In use of the pump, it was found that the pump uses less power when roughing and in general use produces less exhaust pulsation and noise.

I claim:

1. A mechanical vacuum pump comprising:

a pump inlet;

a pump outlet;

at least three pumping chambers located between the pump inlet and outlet;

at least three pairs of intermeshing rotors mounted for rotation within said at least three pumping chambers;

first and second shafts passing through said at least three pumping chambers, a first rotor of each of the at least three pairs of intermeshing rotors mounted on the first shaft and a second roto of each of said at least three pairs of intermeshing roters mounted on the second shaft; and means to drive the first and second shafts in contra-rotating directions to effect a sequential pumping action by the at least three pairs of intermeshing rotors in respect of gas being pumped between said pump inlet and outlet;

at least one of the three pairs of intermeshing rotors having a claw-type profile and at least another of the at least three pairs of intermeshing rotors having a roots-type profile and being located within one of said at least three pumping chambers situated nearest the pump outlet.

2. The pump according to claim 1 in which a further of the at least three pairs of intermeshing rotors has roots-type profile and is located in another of the at least three pumping chambers situated nearest the pump inlet.

3. The pump according to claim 1 or claim 2 comprising at least four stages.

4. The pump according to claim 3 in which other of the at least three pairs of intermeshing rotors located within intermediate chambers of the at least three pumping chambers, situated between said one and another of the at least three pumping chambers, have a claw-type profile.

* * * * *